United States Patent [19]

Nozdrovsky

[11] 4,042,172

[45] Aug. 16, 1977

[54] BOWL CENTRIFUGE ROTOR

[76] Inventor: Andrei Stepanovich Nozdrovsky, Krasnaya ulitsa, 50, kv. 29, Leningrad, U.S.S.R.

[21] Appl. No.: 676,990

[22] Filed: Apr. 14, 1976

[51] Int. Cl.[2] ..... B04B 3/04

[52] U.S. Cl. ..... 233/7; 233/17; 233/46

[58] Field of Search ..... 233/3, 7, 8, 27, 46, 233/47 R, 17, 18

[56] References Cited

U.S. PATENT DOCUMENTS

| | | | |
|---|---|---|---|
| 1,806,241 | 5/1931 | Dupuis | 233/7 |

FOREIGN PATENT DOCUMENTS

| | | | |
|---|---|---|---|
| 876,531 | 8/1942 | France | 233/7 |
| 1,482,721 | 6/1969 | Germany | 233/7 |

*Primary Examiner*—George H. Krizmanich
*Attorney, Agent, or Firm*—Steinberg & Blake

[57] ABSTRACT

A centrifuge rotor comprises a hollow rotary casing provided with windows for discharge of clarified liquid at one end and sediment discharge windows at an opposite end. The casing houses a coaxial hollow screw conveyer, the processed suspension being fed into a cavity of the conveyer from one of its ends. A pack of separating plates is placed in the screw conveyer cavity between the windows for discharge of clarified liquid made in the casing and at least one hollow internal screw conveyer positioned between a pack and the discharge end of the first conveyer, a discharge end of said internal screw conveyer being oriented in the same direction as the external screw conveyer and windows being made in the external screw conveyer wall to let out the sediment discharged from the internal screw conveyer which is rigidly secured to the rotor casing for rotation therewith. A rotor of this design is capable of separate division, thickening, consolidation and transportation of different fractions of the processed suspension permitting division of polydispersed suspensions with a high content of fine fractions with greater efficiency as compared to known centrifuges of the same type.

6 Claims, 2 Drawing Figures

BOWL CENTRIFUGE ROTOR

Figure 1:
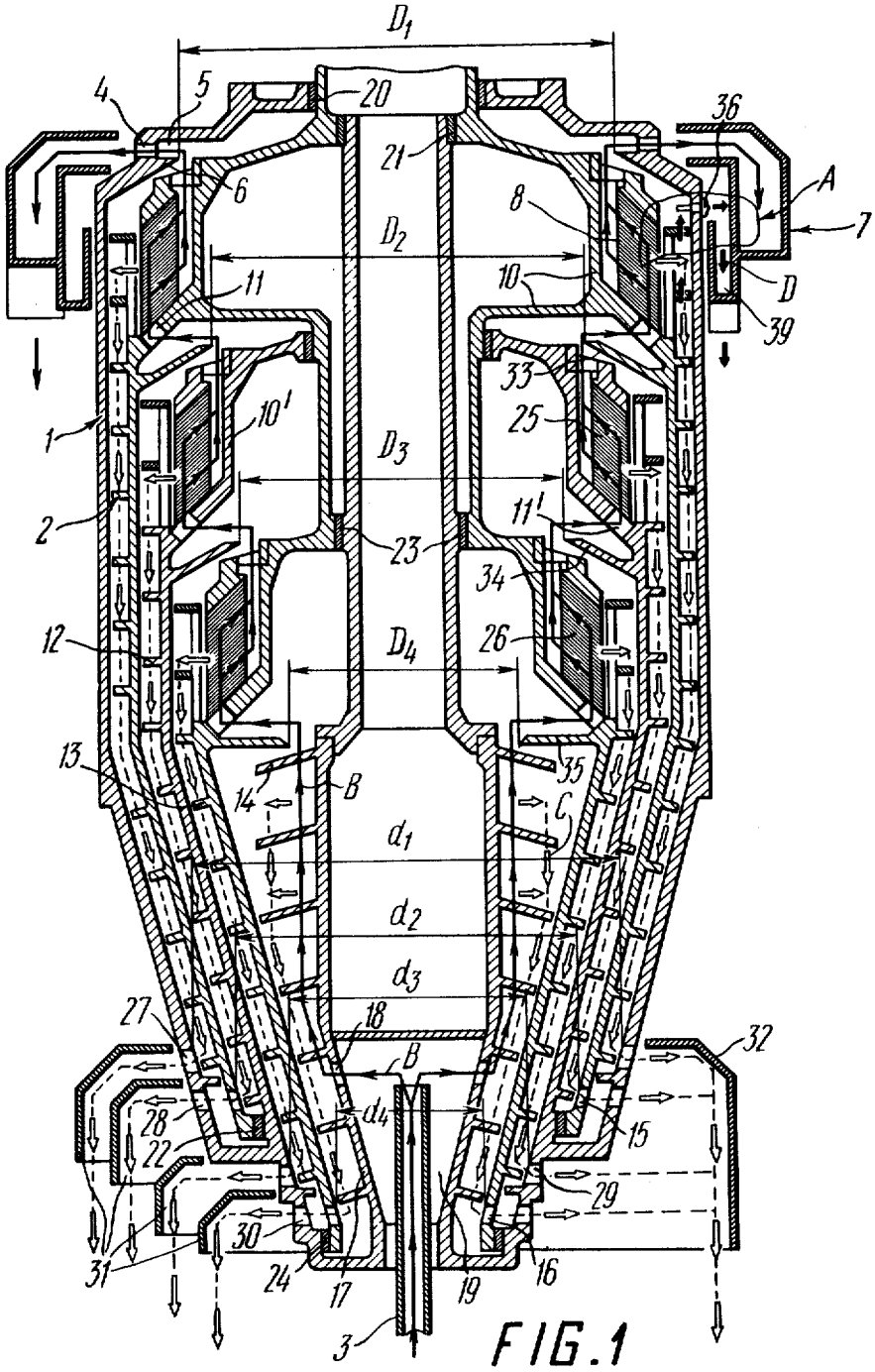

This invention relates to apparatus for separation of suspensions by settling the solid phase particles contained therein under the influence of centrifugal forces and, in particular, to continuous bowl centrifuge rotors extensively used in hydrometallurgy, chemical and other branches of industry wherever separation of suspensions is required.

This invention can be used to best advantage to separate finely dispersed suspensions, which are difficult to separate, their filtration with the help of known filters being either impossible or inefficient and, therefore, unsuited for separation of polydispersed suspensions rich in both coarse and fine solid phase fractions.

The invention can be also used to no less advantage to separate easily filterable suspensions requiring preliminary thickening, since it permits thicknening and filtering to be done in one operation.

The already known continuous bowl centrifuges comprise a hollow casing provided with windows at one end to discharge clarified liquid and windows to discharge the sediment at the other end. The rotor casing houses a coaxial hollow screw conveyer, its cavity being communicated at one end with a device for charging the suspension to be processed and mounting a pack of separating plates placed coaxially with the casing on the side of the windows for discharge of clarified liquid.

The separating plates divide an appropriate portion of the cavity of the conveyor casing into thin conical layers and, consequently, the finest fractions of the suspension solid phase settle intensively on the internal surfaces of the plates in the process of centrifuge operation. The walls of the conveyer casing of such rotors of the known bowl centrifuges are provided with windows to transmit the solid phase of the suspension to the walls of the rotor casing in the process of its rotation, the solid phase of the suspension produced both in the charging area and by the pack of separating plates being further moved by the screw conveyer to the windows of the casing to discharge the sediment.

One of the main disadvantages of the rotors of the known bowl centrifuges is that, when they work on polydispersed suspensions rich in fine fractions of the solid phase, coarser fractions settle in the area between the charging zone and clarification zone quicker than the finer ones and impede the passage of the latter to the discharge windows of the rotor casing. In consequence, known centrifuges operating on polydispersed suspensions rich in fine fractions have such a poor performance that their employment in this case is inexpedient.

Simultaneous settling of coarse and fine fractions of the solid phase of the suspension makes thickening and consolidation of the latter more difficult due to their roiling and results in sharp decrease of efficiency of the centrifuge.

Besides, simultaneous thickening, consolidation and transportation of all fractions of the solid phase of the suspension at a uniform distance from the axis of rotation of the rotor, that is in the area of action of maximum centrifugal forces, causes unjustified increase of load on the working parts of the centrifuge and of energy consumption. In addition, it also drastically steps up wear of the screw conveyer and other parts of the centrifuge rotor, particularly in the suspension charging area due to excessive loads and speeds of relative sliding of the sediment over the surface of the screw conveyer spires.

It should be also borne in mind that, when known centrifuges operate on suspensions rich in very fine fractions, they have no time to consolidate completely to the required consistency to be transported by the screw conveyer and it cannot ensure their complete discharge. In consequence, the rotor cavity is soon overfilled with fine fractions, normal operation of the centrifuge is disturbed and the surplus of fine fractions is discharged with the centrifuge effluent.

To prevent this, the amount of the supplied suspension is drastically reduced resulting in a drop of efficiency of the centrifuge.

The object of this invention is to provide a bowl centrifuge rotor ensuring separate division, thickening, consolidation and transportation of different fractions of the solid phase of the processed suspension depending on the size of particles permitting separation of polydispersed suspensions high in fine fractions with good performance.

Another object of this invention is to raise the quality of clarification of the liquid phase of the suspension and, consequently, to increase the performance of the centrifuge.

Yet another object of the invention is to ensure a possibility for fine sizings of the suspension solid phase simultaneously with the separation of the suspension, the particles thus separated being up to 3 microns large.

Besides, one of the objects of the invention is to lengthen the service life of the centrifuge, reduce loads on the working parts of the rotor and, consequently, decrease their weight, dimension and energy consumption.

These and other objects are achieved in that a bowl centrifuge rotor casing provided with windows for discharge of clarified liquid at one end and windows for discharge of the sediment at the opposite end houses a coaxially installed hollow screw conveyer, its cavity being communicated from one of the ends with a device for supply of the suspension to be processed and a pack of separating plates being placed therein in the path of flow toward the windows in the casing for discharge of clarified liquid. The screw conveyer cavity houses, in accordance with the invention, at least one hollow internal screw conveyer coaxially installed between its discharge end and a separating plate pack, said internal conveyer having its discharge end directed similarly to the external screw conveyer, the walls of said external conveyer having windows for discharge of the sediment produced by the internal screw conveyer which is rigidly secured to the rotor casing for rotation therewith.

Such design permits elimination of the influence of the quicker settling of coarse fractions of the suspension solid phase upon the discharge of its finer fractions by successive isolation of fractions of different sizes and their separate thickening, consolidation and transportation by respective screw conveyers, as well as intensification of these processes by increasing, all other things being equal, the operating surface.

Besides, since the proposed design of the rotor ensures thickening, consolidation and transportation of coarse fractions of the solid phase of the processed suspension to be performed at less diameters as compared to finer ones the load on the working parts of the rotor is decreased, their wear is reduced together with the energy consumption.

In consequence, the efficiency of the centrifuge operating on polydispersed suspensions high in fine fractions of the solid phase is increased manyfold, as well as its service life. Operational expenditures are reduced and the quality of suspension separation is raised.

It is expedient that, when more than one internal screw conveyers are available, the even conveyers, counting from the outer one as the first, are rigidly secured to the rotor casing and uneven ones are rigidly secured to the outer conveyer.

This ensures relative rotation of adjacent screw conveyers required for transportation of the sediment using only one gear reducer.

It is also expedient that the cavity of at least one internal screw conveyer houses an appropriate additional pack of separating plates.

The range of sizes of separately thickened, consolidated and transported fractions of the solid phase is in this way narrowed and the intensity of these operations is increased, as well as the quality of clarification of the liquid phase and the general performance of the centrifuge.

Besides, whenever necessary an extremely fine sizing of the solid phase may be ensured.

A part of internal cavity of each external screw conveyer, wherein an adjacent internal screw conveyer is situated, may be divided from the internal rest of the cavity by an annular tray secured to the inner surface of said external screw conveyer.

The already settled solid phase cannot therefore get into the cavity of an adjacent screw conveyer and the working cavities of each of the screw conveyers can be filled differently ensuring a more compact design of a rotor.

Windows for discharge of the sediment in the walls of adjacent screw conveyers are made at different levels along their axis, whereas the windows for discharge of the sediment in the casing are made at respective levels for the external and each of internal screw conveyers to ensure separate discharge of the sediment transported thereby.

This protects the screw conveyers and the rotor casing against excessive wear in the discharge area, brings down energy expenditure and permits sizing of the solid phase coincidentally with separation of the suspension.

In one of he embodiments of the invention the walls of the casing are provided with at least one nozzle positioned between its annular tray and the beginning of the first spire of the external screw conveyer, the inlet port of said nozzle being positioned in the cavity of the rotor casing beyond the area occupied in the radial direction by the sediment transported by said screw conveyer.

Such arrangement permits in the course of separation of suspensions rich in extremely fine fractions of the solid phase discharge through said nozzle of only that portion of fine fractions produced by the pack of separating plates, which has no time to consolidate to the consistency to be transported by the screw conveyer and, also, precludes discharge through said nozzle of the rest of the solid phase. This ensures higher efficiency of the centrifuge and at the same time prevents excessive wear of nozzles, their clogging and unjustified increase of the water content in the solid phase separated by the centrifuge.

Besides, when the total water content of the separated solid phase is virtually immaterial according to service requirements, the proposed design ensures the necessary efficiency through the use of a centrifuge featuring a rotor of a simpler construction (with two or even one screw conveyer).

Figure 2:
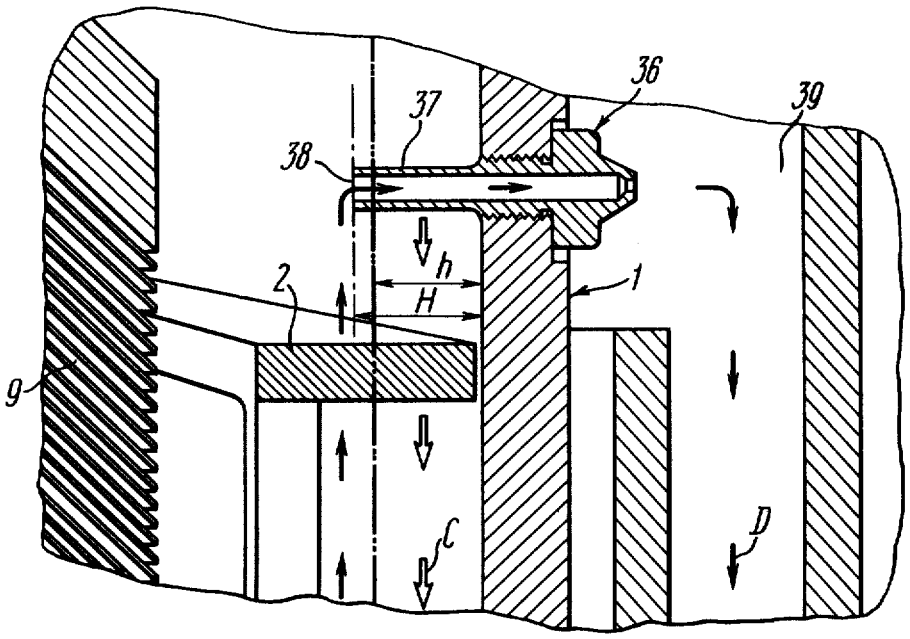

The invention will now be described in greater detail with reference to a specific embodiment thereof, taken in conjunction with the accompanying drawings, wherein:

FIG. 1 shows a schematic longitudinal section of a general view of a rotor of a vertical bowl centrifuge, according to the invention:

FIG. 2. shows an enlarged view of the "A" part of FIG. 1.

A rotor of a vertical bowl centrifuge comprises a hollow casing 1 (FIG. 1), its upper end being essentially cylinder shaped and the lower end being a coaxial mated truncated cone narrowing downward.

The cavity of the casing 1 houses a coaxial hollow screw conveyer 2 also having cylindrical and conical portions positioned in respective ends of the casing 1.

The inner cavity of the screw conveyer 2 communicates at its lower discharge end with a device for filling the suspension to be processed (not shown) through a feed pipe 3 rigidly secured along the rotor axis.

The walls of the upper end of the casing 1 are provided with radially positioned windows 4 for discharge of clarified liquid (centrifuge effluent) from a collecting cavity 5 of the casing 1 separated along the periphery from the rest of the cavity by an annular tray 6, to the surrounding rotor casing 1 and a receptacle 7 for the centrifuge effluent installed on the casing foundation.

A pack 8 of separating plates 9 of any known design is installed in a cavity of the screw conveyer 2 in the path of flow toward the windows 4 for discharge of clarified liquid. In this embodiment the plates 9 (FIG. 2) are mounted on a cylindrical part of a casing 10 of the pack 8 coaxial to the screw conveyer 2 and secured therein to align the plates 9 by their inner edges. In its lower part the casing 10 has a conical portion, the pack 8 of the separating plates 9 resting thereupon, provided with through holes 11 to let the processed suspension flow from the cavity of the screw conveyer 2 to the gaps between the plates 9 through holes made therein (not shown). The upper part of the casing 10 of the pack is provided with a pintle to secure the external screw conveyer 2 coaxially in the casing 1.

At least one hollow internal screw conveyer is, according to the invention, installed coaxially in the cavity of the screw conveyer 2 between its discharge end and the pack 8 of separating plates 9, said internal conveyer being oriented at its discharge end in the same direction as the external screw conveyer 2.

In this embodiment the external screw conveyer 2 houses three internal screw conveyers 12, 13 and 14 coaxially positioned one in the next. The walls of the discharge ends of the external screw conveyer 2 and the internal screw conveyer 13 are provided with respective windows 15 and 16 to discharge the sediment produced respectively by the internal screw conveyers 12 and 14.

A wall of the innermost screw conveyer 14 is provided with windows 18 to pass the processed suspension from its inner cavity 19, which is the charging cavity receiving the suspension to be processed through the feed pipe 3, into the inner cavity of the adjacent screw conveyer 13.

When a plurality of internal screw conveyers are available, the uneven ones, counting from the outer screw conveyer 2, as the first are, according to the invention, rigidly secured thereto and the even ones are secured to the casing 1 of the rotor for simultaneous rotation.

In this embodiment the inner screw conveyer 13 is rigidly secured to the external screw conveyer 2, whereas the internal screw conveyers 12 and 14 are secured to the casing 1.

In this case the conveyers 2 and 13 have right screw surfaces and the conveyers 12 and 14 have left screw surfaces (or vice versa).

The external screw conveyer 2 is mounted in the casing 1 of the rotor on radial bearings 20, 21 and 22 permitting their relative rotation and kinematically connected with a reducing gear (not shown).

The internal screw conveyer 13 is rigidly secured to the external screw conveyer 2 and rotates on bearings 23 and 24. The bearing 23 is mounted on the internal tube passing along the rotor axis. The upper end of said tube rests on the bearing 21 and the lower end is rigidly connected to the internal screw conveyer 14, which in its turn like the screw conveyer 12 is rigidly secured by its lower end to the butt end of the rotor casing 1.

Another embodiment of the invention may have an additional pack of separating plates installed in the cavity of at least one internal screw conveyer. In this embodiment two internal screw conveyers 12 and 13 house respectively packs 25 and 26 of separating plates, their outer and inner diameters diminishing as the diameters of the internal screw conveyers 12 and 13 diminish in respect to the diameter of the external screw conveyer 2. The packs 25 and 26 are designed similarly to the pack 8 and the casing 10 of said pack 8 is made integral with the casing of the pack 26.

Windows 15 and 16 for discharge of the sediment made in the walls of the discharge ends of respectively the external screw conveyer 2 and the second integral screw conveyer 13 are positioned at different levels in concentric rows along the rotor axis, whereas the casing 1 has at respective levels four rows of windows 27, 28, 29 and 30 for separate discharge of the sediment transported by the screw conveyers 2, 12, 13 and 14, respectively.

In this case the lower part of the rotor casing 1 is, surrounded by stationary receptacles 31 or 32. The receptacles 31 are intended for separate production of sediments and the second receptacle 32 is intended for their further joint use.

One more feature of the invention comprises parts of internal cavities of the screw conveyers 2, 12 and 13, wherein respective adjacent screw conveyers 12, 13 and 14 are situated, separated from their rest parts by a respective annular tray 33, 34 or 35 secured on the internal surface of said screw conveyer 2, 12 or 13, respectively.

To prevent pouring out of the processed suspension through the windows 27, 15, 29 and 16 for the discharge of the sediment, diameters $d_1$, $d_2$, $d_3$ and $d_4$ of the circles touching the inner edges of these the windows 27, 15, 29 and 16 should be less than the diameters $D_1$, $D_2$, $D_3$ and $D_4$ of the annular trays 6, 33, 34 and 35 respectively.

At least one nozzle 36 for discharge of the finest classes of fine fractions of the solid phase can be placed, according to the invention, in the upper part of the rotor casing between its annular tray 6 and the beginning of the first spire of the external screw conveyer 2 in a through hole made in the wall of the casing 1, said nozzle having a part 37 (FIG. 2) protruding into the cavity of the casing 1 with an inlet port 38 positioned at a distance H from the wall of the casing 1, which is larger than a zone *h* occupied in the rotor radial direction by the sediment transported by the external screw conveyer 2.

The movement of the suspension and clarified liquid is shown in FIGS. 1 and 2 schematically by thin black lines with arrows B, the movement of the solid phase by a dashed line with white arrows C and the movement of the fine part of the solid phase discharged by the nozzle 36 by black thick arrows D.

The centrifuge operates as follows.

Rotary motion is imparted to the rotor casing 1 by the main drive, whereas the screw conveyers 2 and 13 are rotated from the casing I through a reducing gear (not shown) ensuring a certain lag (30–40 r.p.m.) in their rotation in respect to the rotation of the casing 1 and, consequently, of rigidly connected internal screw conveyers 12 and 14.

During rotation of the rotor the suspension to be processed is directed as indicated by the arrows B ( FIG. 1) from the feed pipe 3 and is supplied to the feed cavity 19 of the internal screw conveyer 14, wherein it acquires a rotary motion and under the action of the centrifugal force comes into the inner cavity of the screw conveyer 13 adjacent to the screw conveyer 14.

It is well known that at large speeds of rotation the surface of liquid in a rotating vessel acquires a paraboloid form of a very slight curvature and can be regarded as a cylindrical form.

As the inner cavity of the screw conveyer 13 is filled with the suspension, the diameter of its surface diminishes until it is equal to the diameter $D_4$ of the annular tray 35 of said screw conveyer 13. It is not further diminished, since the surplus of the suspension overflows the annular tray 35 into the inner cavity of the adjacent screw conveyer 12. The suspension passes the pack 26 of separating plates and flows over the annular tray 34 of the screw conveyer 12 into the inner cavity of the screw conveyer 2, and through the holes $11^1$ in the casing $10^1$ enters the pack 25 of separating plates and afterwards over the annular tray 33 of the external screw conveyer 2 into the inner cavity of the rotor casing 1 to the holes 11 in the casing 10 of the pack 8. Having passed through the pack 8 the suspension flows over the annular tray 6 of the rotor casing 1 into its collecting cavity 5 and therefrom through the windows 4 in the casing 1 into the receptacle 7 for the centrifuge effluent.

From this moment on, uninterrupted movement of liquid starts from the pipe 3, where it is charged, to the annular tray 6 of the casing 1. This movement can occur only along stricly restricted routes described above.

The process of settling of the solid phase particles contained in the suspension goes on continuously all along its path from the place of filling to the inner cavity of the pack 8 of separating plates.

The coarsest and quicker settling particles separate out of the flow and settle on the inner walls of the screw conveyer 13, medium size particles partly separating out in the same zone and partly on the way to the annular tray 35. The bulk of fine particles with the remains of medium size fractions come with the liquid into the gaps between the plates of the pack 26.

Here, owing to the narrow clearance between the separating plates and, consequently, insignificant length for settling of particles, on the one hand, and laminar and relatively slow movement of liquid, on the other hand, the reamins of medium size fractions and a part of fine ones quickly settle on the internal surfaces of respective plates.

Medium size particles of fine fractions of the solid phase are similarly isolated in the pack 25 of separating plates and the finest portion, that is the remains of the fine fractions, is isolated in the pack 8. As a result, the clarified liquid, that is the centrifuge effluent, is supplied over the annular tray 6 of the rotor casing into the collecting cavity 5 and then through the windows 4 into the receptacle 7.

Coarse and medium size fractions of the solid sediment settling on the inner surfaces of the screw conveyer 13 are consolidated and, owing to slow relative rotation of adjacent screw conveyers 14 and 13, are transported by the conveyer 14 to its discharge end and through the windows 16 in the screw conveyer 13 and the windows 30 in the rotor casing 1 they are discharged either into the receptable 31 (in case the obtained fractions are used separately) or into the receptacle 32 (in case all fractions are mixed).

Finer classes of fine fractions separated in the packs 26, 25 and 8 flow under the action of the centrifugal force along the separating plates and concentrarte respectively at the walls of the screw conveyers 12 and 2 and the rotor casing 1, wherein they are thickened, consolidated and transported by respective screw conveyers 13, 12 and 2 to the respective discharge windows 16, and 30, 29, 15 and 28, 27 and discharged either into respective compartmemt of the receptacle 31 or into the common receptacle 32.

Each of the three classes of fine fractions of the sediment is thickened, consolidated and transported separately from one another and from medium and coarse fractions and this creates most favourable conditions for their consolidation and discharge. Besides they are transported by the three screw conveyers 2, 12 and 13 and, consequently, the area of consolidation and the solid phase efficiency of the centrifuge operating on suspensions rich in fine fractions of the solid phase (all other things being equal) is increased threefold.

In this case the sediment is not diluted by the liquid phase and its water content may be brought down to minimum.

Since coarse fractions are separated, consolidated and transported at lesser than fine fractions distances from the rotor axis of rotation, the load on the screw conveyers 2, 12 and 13 and the reducing gear is decreased, energy consumption and centrifuge parts wear are reduced, particularly in the suspension charging and sediment coarse fractions discharge areas. The external screw conveyer 2 and the internal conveyers 12 and 13 practically never wear out and can operate for a long time.

The proposed bowl centrifuge rotor is capable of performing the functions of actually four successively operating rotors of known centrifuges: one single screw conveyer rotor without a pack of plates and three screw conveyer rotors equipped with packs of separating plates of appropriate size. But the proposed rotor displays significantly better performances and efficiency, because its last three stages are barred from the harmful influence of the filled suspension in the charging area. In this case all intermediate devices for receiving and charging of the suspension and centrifuged products are eliminated, and manyfold reduction of the working space, labour expenditures, energy consumption, etc., is achieved.

Besides, the solid phase may be divided into four and more classes of size, and fine fractions of the sediment may have extremely precise sizes, isolating particles of 2–3 microns.

The obtained products can be made to contain finest particles of a required size by proper selection of parameters of the packs 8, 25 and 26 of separating plates and adequate operation of the centrifuge, which is of undoubted interest for ceramics and paper industries and the like.

When polydispersed suspensions with an unusually high content of superfine fractions are to be separated, a rotor provided with any nozzle 36 (FIG. 2) is used. (In the given embodiment the nozzle 36 may be stopped or absent).

When a great amount of superfine fractions is present in the suspension, the finest part of them separated by the pack 8 of the separating plates 9 has no time to thicken to the required consistency and cannot be transported by the external conveyer 2 along the spiral channels formed by two adjacent screw surfaces of the conveyer 2, but movess as the arrows D indicate towards the nozzle 36 and is continuously dicharged therethrough into the receptacle 39 separated by a partition from the receptacle 7 of clarified liquid.

As the inlet port 38 of the nozzle 36 is spaced from the inner surface of the rotor casing 1 by a distance H, which is greater than the depth *h* of the layer of already thickened part of the sediment fractions transported by the screw conveyer 2, said part of fractions cannot get into the nozzle 36. This reduces wear of the nozzle, rules out the possibility of its stoppage and reduces the total water content of the solid phase separated by the centrifuge.

Centrifuge rotors provided with one or several nozzles 36 may be also successively used when the total water content of the sediment is immaterial. In this case the number of screw conveyers may be minimum (two or even one).

What is claimed is:

1. A bowl centrifuge rotor comprising a hollow rotary casing having a central axis, an internal cavity, and provided at one end with windows for discharge of clarified liquid and at an opposite end with sediment discharge windows: a hollow external screw conveyer installed in the cavity of said casing and being coaxial therewith, said conveyer having a discharge end oriented in the direction of the sediment discharge windows in said casing and provided with sediment discharge windows of its own, said external screw conveyer having a cavity for receiving at an end of said conveyer a suspension to be processed; a pack of separating plates positioned adjacent said external screw conveyer coaxial therewith in the path of flow of the suspension, during processing thereof, toward the windows made in said casing for discharge of clarified liquid; at least one internal screw conveyer installed in the cavity of said external screw conveyer coaxial therewith between its discharge end and said pack of separating plates and having a charging end oriented in the same direction as said external screw conveyer and rigidly secured to said casing for rotation therewith, as a result of which different sizes of solid phase fractions of the processed suspension are transported separately by said screw conveyers.

2. A rotor as claimed in claim 1, including a plurality of internal screw conveyers situated one in the next, and wherein, counting from the external conveyer as the first, any internal conveyer of an uneven number is rigidly secured to the external conveyer for rotation therewith and any conveyer having an even number is secured to the casing for rotation therewith.

3. A rotor as claimed in claim 1, wherein said internal screw conveyer has a cavity, and an additional pack of separating plates situated in the latter cavity.

4. A rotor as claimed in claim 1, wherein an annular tray is secured to an inner surface of said external screw conveyer separating a part of the internal cavity thereof from the rest of the latter internal cavity.

5. A rotor as claimed in claim 1, wherein sediment discharge windows in the walls of said screw conveyers are made at different levels along said axis, whereas sediment discharge windows in the casing are made at said levels for the external and internal screw conveyers for separate discharge of transported sediment.

6. A rotor as claimed in claim 1, wherein said casing has a wall carrying in the cavity of said casing betwen said windows thereof for discharge of clarified liquid and said external screw conveyer an annular tray and at least one nozzle situated between said tray and the beginning of the first spire of the external screw conveyer for discharge of fine fractions of a suspension solid phase, said nozzle having an inlet port situated in the casing cavity beyond a zone occupied in the radial direction by sediment transported by said external screw conveyer.

* * * * *